US006966584B2

(12) United States Patent
Debrody et al.

(10) Patent No.: US 6,966,584 B2
(45) Date of Patent: Nov. 22, 2005

(54) PADLOCK SEAL

(75) Inventors: Robert F. Debrody, Wayne, NJ (US); George Albert Lundberg, Jr., Pompton Plains, NJ (US); Peter Farbaniec, Colonia, NJ (US); Richard Dreisbach, North Arlington, NJ (US); Louis J. Mattos, West Carteret, NJ (US)

(73) Assignee: E. J. Brooks Company, Livingston, NJ (US)

( * ) Notice: Subject to any disclaimer, the term of this patent is extended or adjusted under 35 U.S.C. 154(b) by 0 days.

(21) Appl. No.: 10/262,156

(22) Filed: Oct. 1, 2002

(65) Prior Publication Data

US 2004/0061340 A1 Apr. 1, 2004

(51) Int. Cl.[7] ..... B65D 27/30

(52) U.S. Cl. ..... 292/307 R; 292/307 A; 292/315; 292/318; 292/319; 292/320; 292/321; 292/322; 292/326; 24/16 R; 24/16 PB; 24/630

(58) Field of Search ..... 292/307 R, 315, 292/318, 319, 320, 321, 322, 326, 307 A; 24/16 R, 16 PB, 630

(56) References Cited

U.S. PATENT DOCUMENTS

| | | | | |
|---|---|---|---|---|
| 546,619 A | | 9/1895 | MacCarthy | |
| 556,029 A | | 3/1896 | Shipley et al. | |
| 622,599 A | | 4/1899 | Brooks | |
| 884,604 A | | 4/1908 | Murray | |
| 998,878 A | * | 7/1911 | Dinsmoor | 292/320 |
| 1,017,950 A | * | 2/1912 | Brooks | 292/317 |
| 1,048,837 A | * | 12/1912 | Jessup | 292/318 |
| 1,054,440 A | * | 2/1913 | Murray | 292/320 |
| 1,132,970 A | * | 3/1915 | Peyton | 292/307 R |
| 1,239,966 A | | 9/1917 | Reynolds | |
| 1,333,276 A | | 3/1920 | Murray | |

(Continued)

FOREIGN PATENT DOCUMENTS

EP 0 223 905 6/1987

*Primary Examiner*—Daniel P. Stodola
*Assistant Examiner*—Carlos Lugo
(74) *Attorney, Agent, or Firm*—Carella, Byrne et al.; John G. Gilfillan, III; William Squire

(57) ABSTRACT

A molded thermoplastic body is formed with a rectangular cavity. A molded thermoplastic insert is welded to the body in the cavity and has a top cross member, a stem member and a bottom member. The stem member has a plurality of molded fingers cantilevered on opposing sides inclined relative to the stem member longitudinal axis in one embodiment. The stem member forms the cavity into two channels. A wire shackle which may be round or square in section, a wire or molded plastic, is U-shaped with two legs. One leg is formed with notches to receive the tips of the fingers in one channel and the other leg is formed with a reversibly bent barb which engages the fingers in the other channel on the opposite side of the cavity. The bottom member limits the insertion depth of the legs. The notches and barb engage the fingers and lock the shackle to the body. When the shackle is severed, and the notched leg rotated to disengage the notches in the leg from the fingers to remove the leg from the body, the other leg with the barb can not be rotated and readily removed to thereby provide evidence of tampering. Other embodiments are disclosed including providing the notched leg with squared sides and an entrance opening into the corresponding channel that is square to preclude rotation of the notched leg and shackles of different configurations.

55 Claims, 7 Drawing Sheets

U.S. PATENT DOCUMENTS 1,902,665 A * 3/1933 Reinhold ..... 70/39
2,020,198 A * 11/1935 Miller ..... 292/328
3,192,584 A * 7/1965 Pape ..... 24/16 PB
3,375,033 A 3/1968 Moberg
3,739,429 A * 6/1973 Kohke ..... 24/16 PB
3,838,878 A 10/1974 Femberg et al.
3,973,293 A * 8/1976 Noorily ..... 24/16 PB
4,424,994 A * 1/1984 Dowden ..... 292/318
4,460,203 A 7/1984 Moberg et al.
4,687,240 A 8/1987 Swift
4,832,387 A 5/1989 Guiler
4,836,590 A * 6/1989 Swift ..... 292/320
4,887,855 A * 12/1989 Tritton et al. ..... 292/307 R
4,893,853 A * 1/1990 Guiler ..... 292/320
4,895,402 A 1/1990 Tomita
4,909,552 A 3/1990 Weber et al.
5,230,541 A * 7/1993 Nowak ..... 292/288
5,314,219 A * 5/1994 Georgopoulos et al. .... 292/320
5,364,141 A 11/1994 King
5,427,423 A * 6/1995 Georgopoulos ..... 292/320
6,398,273 B1 * 6/2002 Aichmann ..... 292/323
6,416,091 B1 7/2002 Wenk et al.

* cited by examiner

FIG. 18
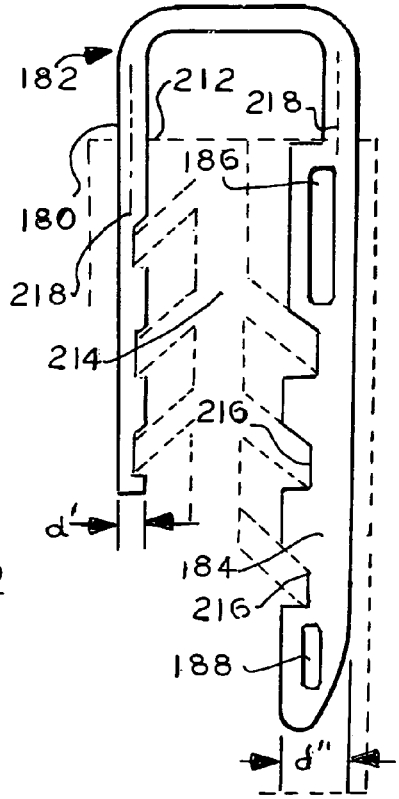
FIG. 1
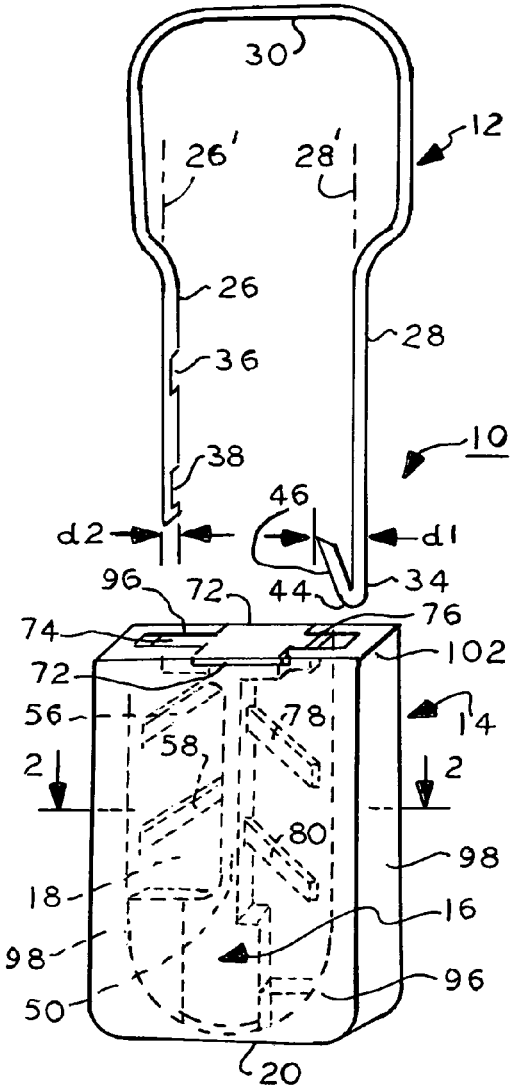
FIG. 6
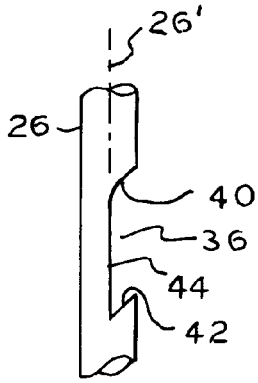
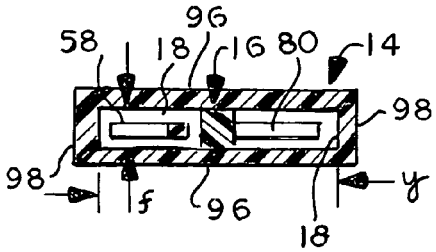
FIG. 2

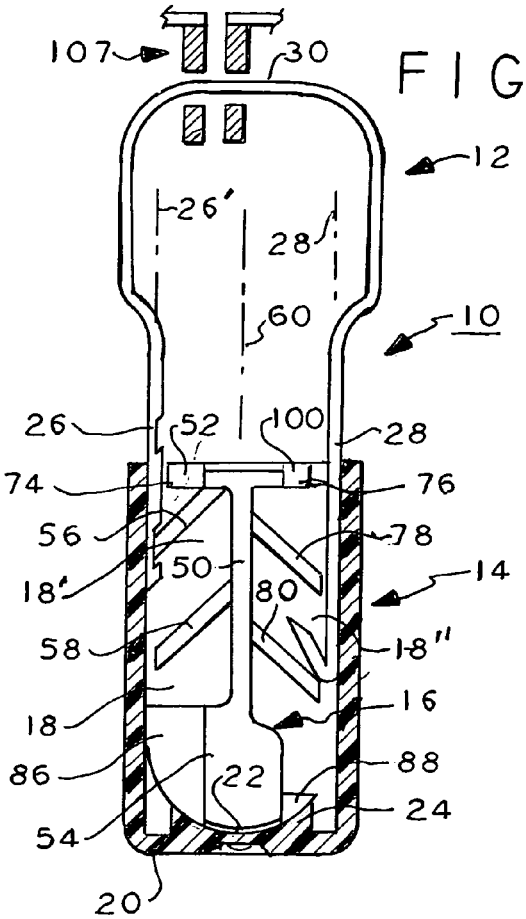
FIG. 8
FIG. 7
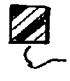
FIG. 9
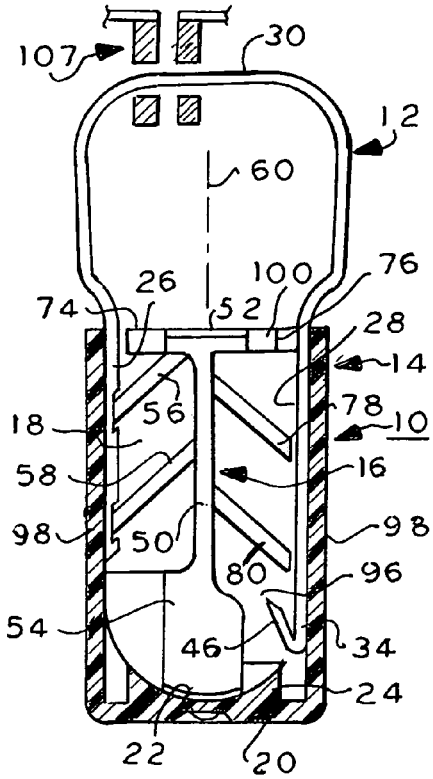
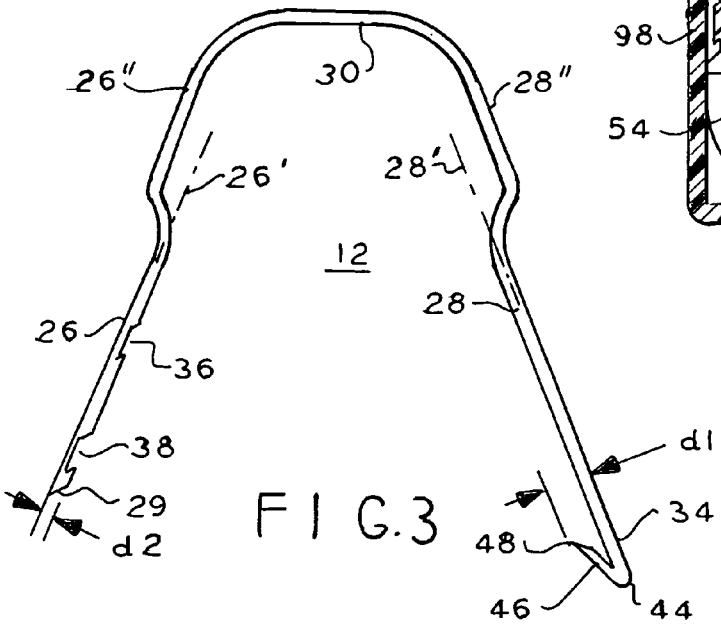
FIG. 3

PADLOCK SEAL

This invention relates to security seals, and more particularly, to molded plastic padlock seals with elongated wire shackles which include engagement arrangements which cooperate with and engage padlock bodies and/or inserts or devices in the padlock body cavity.

Thermoplastic molded security padlock type seals are in wide use. One type of such seal includes an elongated shackle, which typically is a U-shaped bent wire with a reversibly bent barb at each end of the shackle. In some cases, the shackle may have notches at each end which engage mating elements in the body cavity such as wires or metal plates with apertures which receive the shackle.

The bodies, typically molded plastic, have a cavity, some cavities with plastic inserts, wherein the body or inserts have molded steps or shoulders which receive and engage the barbs to preclude withdrawal of the shackle from the body cavity.

For example, U.S. Pat. No. 4,460,2203 discloses a wire shackle having long and short straight legs. The shackle may be provided with notches. The seal has a plastic body with spaced apertures to receive the legs. A spring steel fastener, sheet metal, is inside the body. The fastener has openings defined by spaced cantilevered tongues to receive the legs. The tongues have edges that engage and lock to the legs. The tongues bite into the shackle when it is withdrawn to weaken it. The tongues may also engage the notches if present to lock the shackle legs to the fastener.

Commonly owned EPO application 0 223 905 and U.S. Pat. No. 4,687,240 disclose a padlock seal including a body with spaced apertures and a pair of grooves on opposite outer sides of the body. A U-shaped wire shackle has two legs each with a reversibly bent end portion forming a barb. The barbs are intended to dig into the internal surface of the walls of the body apertures to prevent retraction of the shackle. The body has two parallel channels formed by a central member having a series of two mirror image stepped shoulders spaced axially in each channel. The barb tips engage a corresponding shoulder to lock the shackle to the body and dig into the shoulders into the external grooves when an attempt is made to withdraw the shackle.

U.S. Pat. No. 622,599 discloses a U-shaped wire shackle having two legs each with a hooked notch. A metal casing is divided into two passages. A locking device comprising a spring-metal strip or wire is in the casing and bent to form a bow having a pair of depending legs. A leg is in each passage. The tip of each leg engages a notch on a corresponding shackle leg to lock the shackle legs to the casing.

U.S. Pat. No. 884,604 discloses a cylindrical ceramic seal body with two contracted entrances in communication with an internal cavity. The cavity has a projection distal the entrances and divides the cavity into two spaced recesses. A fastening wire is U-shaped with its ends reversibly bent in a V-shape at an apex bend. The bend at the apex is received in a corresponding one of the recesses. The tips of the bent ends opposite the apices engage a shoulder in the cavity to lock the wire to the cavity.

U.S. Pat. No. 556,029 discloses a U-shaped wire shackle having two legs, each leg with notches. One notch engages a boss in the seal body cavity and the other notch engages a spring catch in the body.

U.S. Pat. No. 1,239,966 discloses a seal comprising a shackle with two legs each with a notch having a shoulder. The seal body has two channels each with a shoulder. The shoulders of the shackle leg notches and body channels interlock to secure the legs to the body.

U.S. Pat. No. 1,333,276 discloses a seal similar to the seal of U.S. Pat. No. 622,599.

U.S. Pat. No. 3,375,033 discloses a seal with a U-shaped shackle having two legs each with a reversibly bent end portion forming a barb. The barb tips engage pockets in a central member forming the seal body into two channels each of which receives a leg and lock the shackle to the body.

U.S. Pat. No. 3,838,878 is similar to the '033 patent just described, but here the outer walls forming the outer surface of the two channels have inwardly projecting projections which engage the tips of the barbs to lock the legs in the corresponding channel.

U.S. Pat. No. 5,364,141 discloses a seal comprising a strap with a tongue end, a locking head at the other end with a key and stop plate disposed therebetween. The tongue is looped around and inserted through the head. As it is pulled tight, the key engages a lock plate inside the head. When the key is fully engaged, the stop plate abuts the head preventing withdrawal of the tongue. The key comprises a series of angled teeth with a sloping surface on one side and a vertical surface on the other side with respect to the strap axis. A plurality of cantilevered inclined flexible pawl teeth are inside the body cavity. In a lock mode, the key teeth are wedged against the slope of the pawl teeth. The pawl teeth have longitudinal side surfaces that abut and lay against the longitudinal side surfaces of the key teeth. The tips of the pawl teeth abut the shoulders of the key teeth to lock the strap in the cavity and prevent its withdrawal. The strap is pulled through the cavity in the forward insertion direction until stopped by the stop plate.

Other padlock seals are disclosed in U.S. Pat. Nos. 6,416,091; 4,832,387; 4,887,855; 4,895,402; 4,909,552 and 546,619.

The problem with U-shaped shackles formed with legs each having the reversibly bent barbs is that the barb tips tend to form an outer envelope with the attached leg (total combined transverse area with the leg having a maximum transverse dimension) wherein the barb tips are widely spaced from the corresponding leg a distance sufficiently great so that the barb can not fit into hasps having small diameter holes, a smaller transverse area. The hasps are used by entities with various apparatuses to be sealed. As a result, the entities need to straighten the barbs to pass the leg(s) through the hasp apertures and then bend the barb back to its desired configuration. This is cumbersome to implement and is not desirable.

The problem with seals using wire shackles with notches is that the seal can be easily defeated. While these have smaller outer envelopes than the reversibly bent barbs combined with the attached shackle leg, these shackles have serious problems with respect to security. The object of the seal is to show tampering. If the seal can be defeated without showing such tampering then the seal does not serve its purpose. The wire shackles with notches can be defeated by severing the exposed shackle portion into two pieces to separate the shackle legs into separate pieces. Once the legs are separated, then each leg can be merely rotated to disengage the notch from the engaged mating locking element. Once disengaged, the shackle leg can then be removed from the body. To return the seal to the locked state, a tamperer merely inserts a new shackle into the seal body. Such shackles are available with unused seals, for example. The removal of the shackle legs is not readily possible with the reversibly bent shackle barbs without showing evidence of tampering. Once inserted, the reversibly bent barbs can not be easily removed from the body cavity without showing tampering. The notched legs, however, are desirable in that they define a relatively small diameter and outer envelope which will fit most small apertures of various hasps presently in use.

A need is seen by the present inventors for a solution to this problem.

A tamper evident security seal according to an aspect of the present invention comprises a body having a cavity with first and second channels. First locking means are in the first channel and second locking means are in the second channel. A shackle is included having first and second legs, the first leg for insertion into the first channel and the second leg for insertion into the second channel. The first leg has third locking means for engaging the first locking means in the first channel to lock the first leg in the first channel, the third locking means and first leg together defining a first outer envelope of a first value. The second leg has a fourth locking means for engaging the second locking means in the second channel, the second leg and fourth locking means defining a second outer envelope having a value smaller than that of the first envelope such that the second leg can pass through an opening smaller than the first leg.

The term envelope value as used herein includes a maximum transverse dimension of an outer envelope, i.e., the leg and locking means associated with that leg or a maximum transverse cross section area of the envelope formed by a shackle leg that is to be inserted into a body entrance opening.

The respective locking means of each leg of a shackle, otherwise of uniform cross section dimensions, including the corresponding leg, by being provided different envelope values, e.g., one leg has a barb and the other leg is notched, permits the smaller notched leg to be inserted into smaller holes in a hasp than otherwise possible with a shackle with two barbed legs. This avoids the problem of easy defeat of the seal if both legs are notched and avoids the problem of difficulty of insertion of the shackle into small hasp holes if both legs are barbed.

In one aspect, the third and fourth locking means are different from each other in configuration.

In a further aspect, the third locking means comprises a reversibly bent barb and the fourth locking means comprises a notch.

In a further aspect, the first and second locking means comprise cantilevered fingers each having a tip portion. Preferably the fingers have identical tip portions.

In a further aspect, the first locking means comprises fingers and the second locking means comprises recesses with shoulders.

In a further aspect, the first and second locking means have different configurations.

In a further aspect, the first locking means comprises metal fingers extending from and secured to a plastic stem member, the stem member forming the cavity into the first and second channels.

In a further aspect, the first and second locking means comprises a stem member in the cavity forming the first and second channels, the stem member including at least one of cantilevered fingers and recesses with shoulders in the channels.

In a still further aspect, the first and second locking means include identical locking portions for selectively engaging either a barb or notch.

In a further aspect, the first and second locking means comprise a plurality of cantilevered fingers forming first and second arrays extending in each channel.

In a further aspect, a first member is in the cavity forming said first and second channels, the first and second locking means comprising a plurality of flexible fingers cantilevered from the first member in each of the first and second channels, the channels extending in an axial direction, the fingers extending transversely to the axial direction in first and second axial arrays, the fingers having tip portions spaced from the body for locking engagement with the notch and barb.

Preferably, the second locking means comprises cantilevered fingers, the fourth locking means comprising a first plurality of notches, a second plurality of notches of the first plurality for engaging a different finger at the same time.

In a further aspect, the third locking means comprises a reversibly bent barb and the fourth locking means comprises a notch and wherein the tip portions are dimensioned to engage either of the notch and the barb.

In a further aspect, the first and second locking means comprise cantilevered fingers, and wherein the fourth locking means comprises a first plurality of notches, a second plurality of the notches of the first plurality for engaging a different finger at the same time, the barb being disengaged from the fingers while the fingers are engaged with the notches.

In a further aspect, the locking means in each channel includes identical locking portions for selectively engaging either the barb or notch.

Preferably, the locking means comprises a plurality of cantilevered fingers forming an array and extending into each channel.

In a further aspect, the body has a bottom wall with an arcuate bottom wall surface in the cavity and the cavity has an open top and enclosed bottom formed by the body bottom wall, the first member forming a stem of a first transverse width and terminating at a first end in a cross member, the cross member overlying a major portion of the fingers and arranged to form first and second entrance openings with the body at the cavity open top, each entrance opening corresponding to a different one of the first and second channels, the first member terminating at a second end distal the first end, the second end being arcuate and complementary to the body bottom wall and overlying the fingers.

In a further aspect, the second leg extends in a first axial direction, the notch being defined by a recess having a parallelogram shape.

Preferably, the finger tips have a shape complementary to the parallelogram shape of the notch recesses for selective engagement in the recesses.

A tamper evident security seal according to a further aspect comprises a body defining a cavity having an opening. A first member forms the opening into first and second entrance openings into the cavity and forms the cavity into first and second channels aligned with a respective different corresponding entrance opening, the first member having opposing first and second sides and a plurality of flexible fingers cantilevered from the first side in the first channel and first locking means at the second side, each finger terminating at a tip portion spaced from the body, the fingers arranged aligned in an array in an axial direction in the first channel, the fingers being inclined relative to the axial direction. A shackle has first and second legs, the first leg for insertion into the first channel and the second leg for insertion into the second channel, each leg having corresponding different second and third locking means for engaging the tip portions and first locking means to thereby lock the legs in the cavity.

A tamper evident security seal according to a still further aspect comprises a transparent molded plastic body having a cavity and first locking means including a molded plastic insert in the cavity, the insert having a stem member and at least one of locking fingers and locking recesses coupled to the stem member, the stem member having an opening therein and formed with molded three dimensional indicia characters in the opening visible through the body. A shackle has second locking means for insertion into the cavity and selective engagement with the first locking means.

A seal according to a further aspect comprises a body having a cavity and a locking member in the cavity and comprising a plastic molded stem member and at least one flexible metal finger extending from and fixed to the stem member. A shackle has a locking leg, the leg having a notch for locking engagement with the at least one metal finger.

IN THE DRAWING

FIG. 1 is an isometric exploded view of a padlock seal according to an embodiment of the present invention;

FIG. 2 is a sectional view of the seal of FIG. 1 taken at lines 2—2;

FIG. 3 is a side elevation view of the shackle of the seal of FIG. 1;

Figure 5:
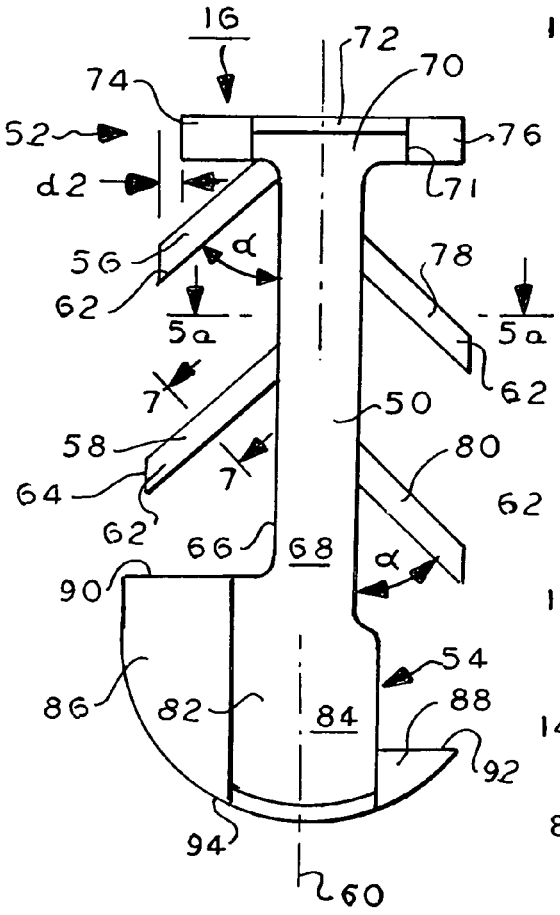
FIG. 5 is a front elevation view of a locking member insert used in the seal of FIG. 1.
Figure 5A:
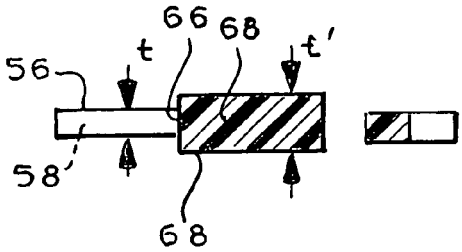

FIG. 5*a* is a sectional plan view of the insert of FIG. 5 taken along lines 5*a*—5*a;*

Figure 12:
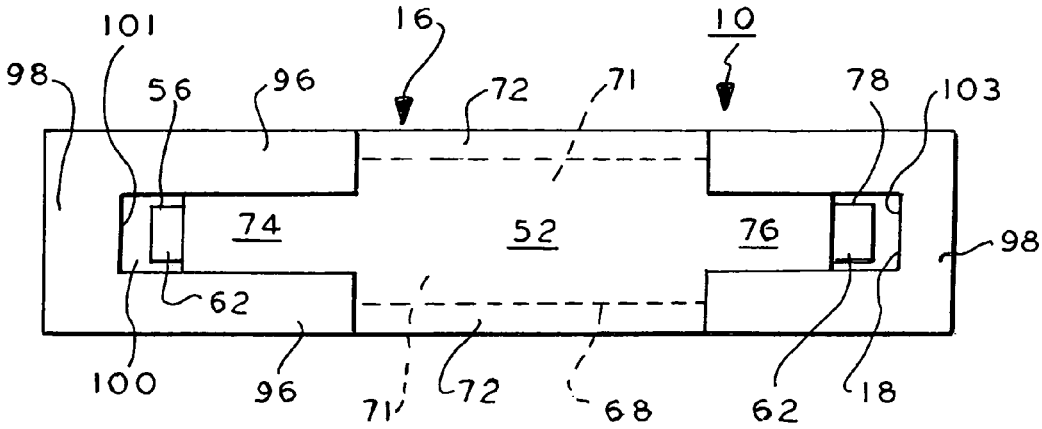
Figure 5B:
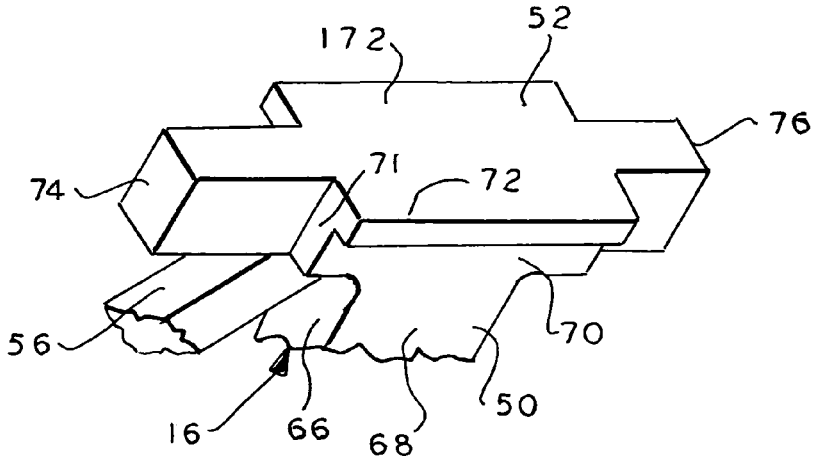
Figure 10:
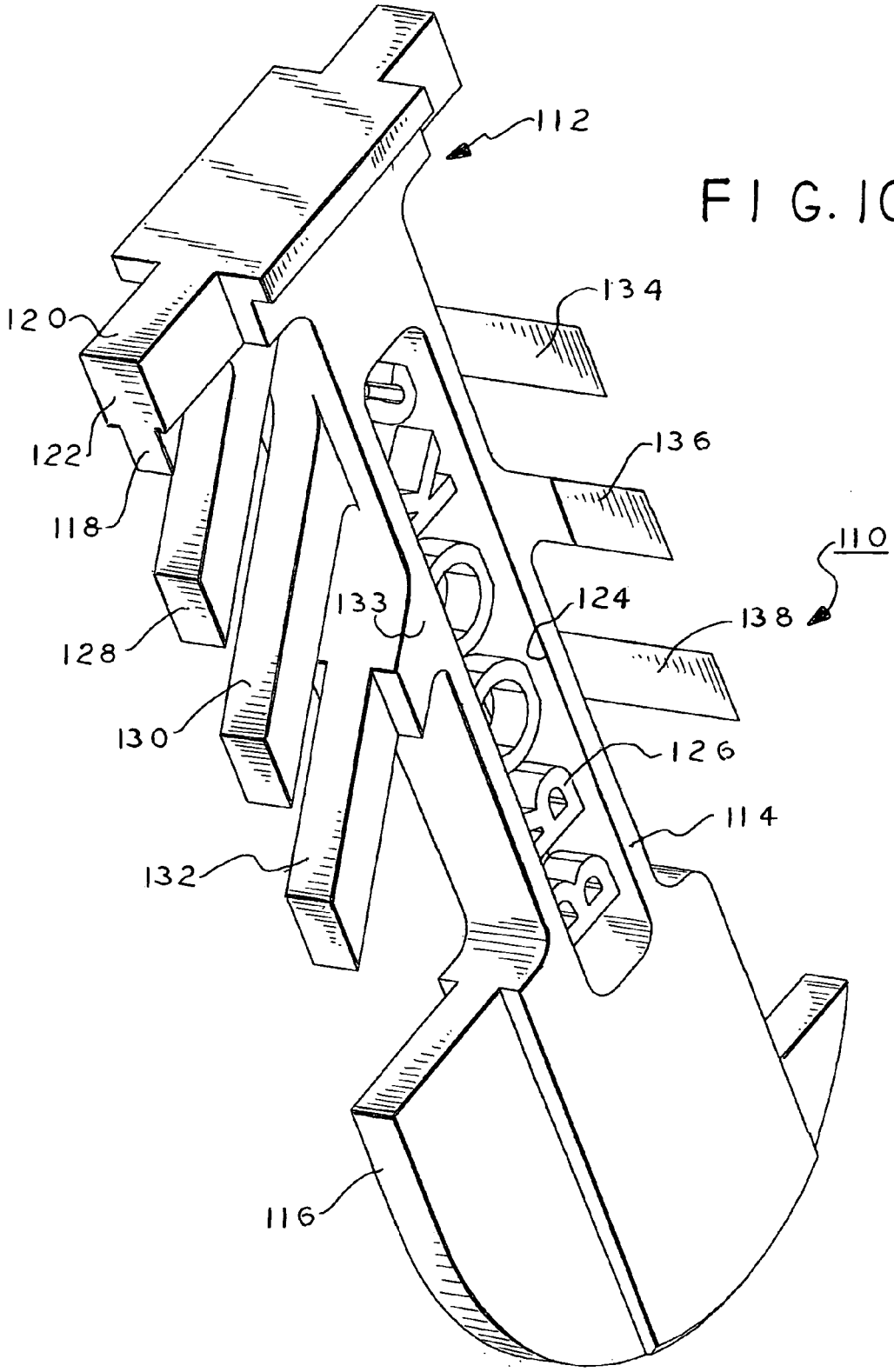
Figure 11:
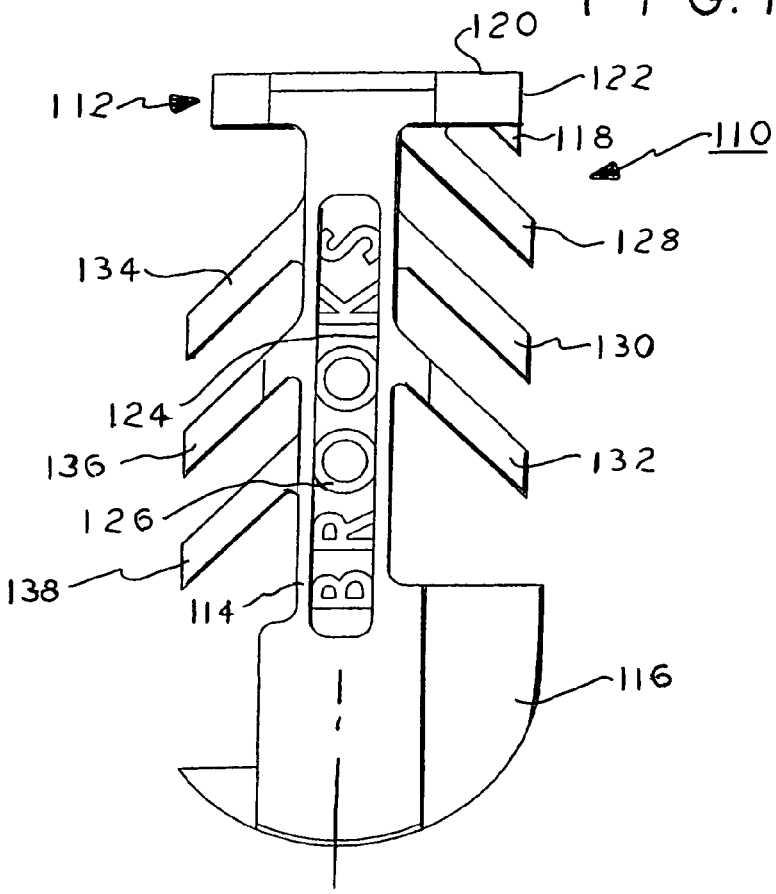
Figure 11A:
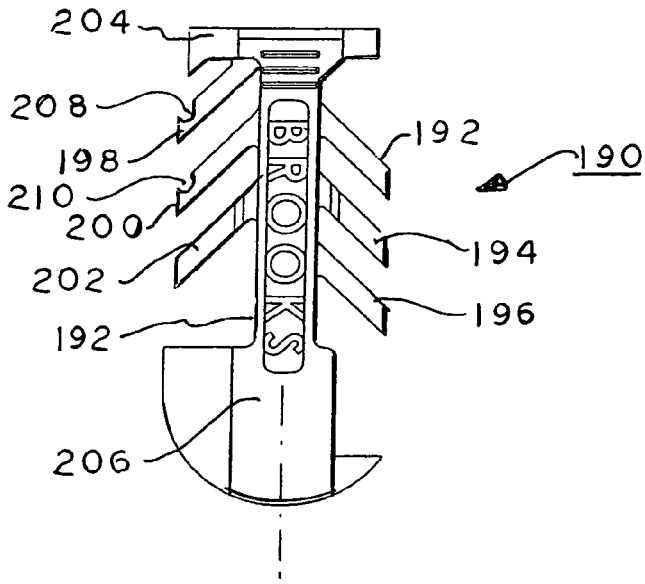
Figure 13:
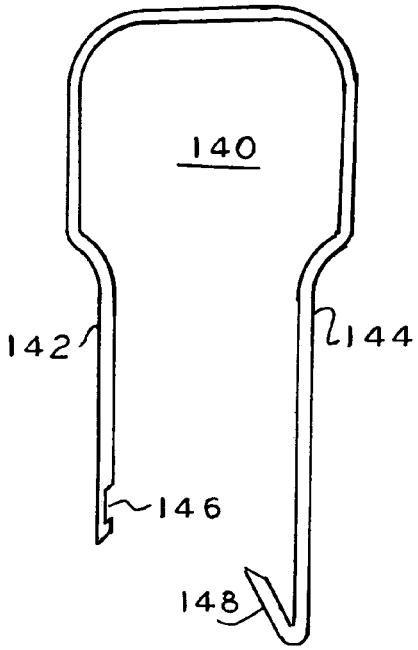
Figure 15:
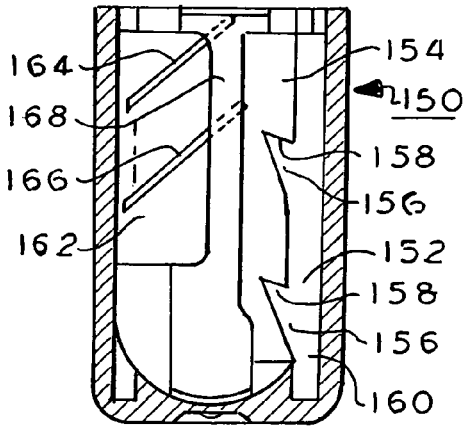
Figure 14:
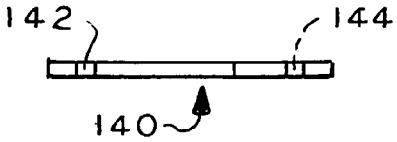
Figure 16:
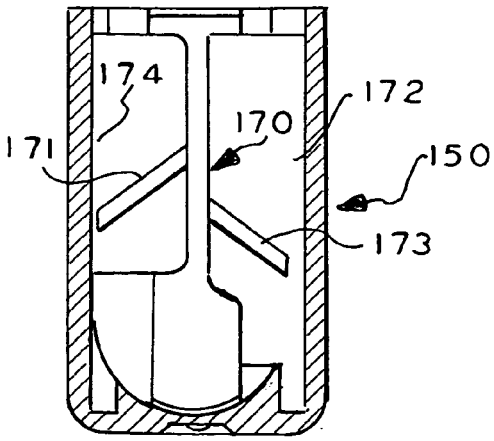
Figure 17:
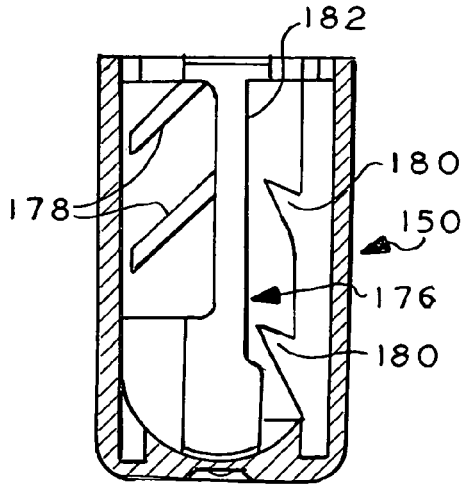

FIG. 5*b* is a fragmented isometric view of the top cross member of the insert of FIG. 5;

FIG. 6 is a side elevation fragmented view of a portion of the shackle showing the notch in more detail;

FIG. 7 is a sectional elevation view of a representative finger in the seal of the present invention;

FIG. 8 is a side elevation sectional view of the seal of FIG. 1 with the shackle in an first locking mode;

FIG. 9 is a side elevation sectional view of the seal of FIG. 1 with the shackle in a second locking mode;

FIG. 10 is an isometric view of an insert according to a second embodiment of the present invention;

FIG. 11 is a front elevation view of the insert of FIG. 10;

FIG. 11*a* is a front elevation view of the insert according to a further embodiment;

FIG. 12 is a top plan view of the insert of FIG. 10 assembled to a body;

FIG. 13 is a side elevation view of a plastic shackle according to a further embodiment of the present invention;

FIG. 14 is a bottom plan view of the shackle of FIG. 13;

FIG. 15 is a side elevation sectional view of a plastic body and locking insert member according to a further embodiment;

FIGS. 16 and 17 are side elevation sectional views of a plastic body and locking insert member according to a still further embodiments; and FIG. 18 is a front elevation view of a shackle according to a further embodiment.

In the Figs., seal 10 includes a shackle 12, preferably round steel wire or in the alternative flat wire, or in a still further embodiment, plastic material, preferably molded, a body 14 and a locking insert 16 which is inside cavity 18 of the body 14.

The body 14 is preferably molded thermoplastic material as is the locking insert 16. The body 14 is also preferably transparent and substantially rectangular, but may be partially transparent and any desired shape such as cylindrical, square and so on. The body 14 cavity 18 is also preferably substantially rectangular in cross section as best seen in FIG. 2, but may be other shapes. The cavity 18 has a transverse dimension x, FIG. 2 and a longitudinal dimension y. The body 14 has a bottom wall 20 that is flat externally and has an arcuate surface 22 formed in inwardly extending projection 24 internally in the cavity 18. The surface 22 is concave and a portion of a circle.

The shackle 12 is preferably bent from metal wire and may be generally U-shaped with two different legs 26 and 28. The shackle 12 may also be molded thermoplastic. The legs 26 and 28 extend along respective axes 26' and 28', FIG. 3, closer together than the leg portions 26" and 28" that are bent from the cross portion 30 forming the base of the U. Leg 28 terminates at end portion 34. Leg 26 preferably has two like notches 36, 38, but may include one or more than two notches.

Representative notch 36, FIG. 6, is formed preferably by two parallel inclined walls 40, 42 that are inclined relative to axis 26' preferably about 45°, and a base wall 44 that is parallel to axis 26' forming a parallelogram. In an alternative embodiment, only wall 40 is inclined, wall 44 being normal to the longitudinal axis of the shackle leg. The shackle 14 by way of example when round circular cylindrical wire, has an envelope value defined by the maximum diameter dimension d2, which determines the cross section area of the circular in section leg. The term envelope value refers to the maximum transverse dimension or area of the cross sectional area of the leg. If the wire is square or rectangular flat wire, then the envelope of the leg is defined by the transverse thickness dimension d2 and the transverse thickness dimension normal to the dimension d2, which define the transverse cross section area of the leg. The value of that envelope, for example, is the maximum of the dimensions d1 and d2. A round or square wire typically may be sufficiently small in its envelope value so as to pass through relatively small hasp apertures used in some implementations. In other words, the envelope is defined by the outer maximum transverse dimensions (which also define area) of the shackle including the locking device such as a barb and so on, whether it be wire or other materials such as high strength fiber reinforced plastic known as engineering plastics, for example, or other plastic material as might be employed in some implementations. The leg notches 36, 38 are depressions in the leg and thus do not affect the leg envelope maximum value.

The leg notches 36, 38, FIGS., 1, 4, 8 and 9, face inwardly toward the space between the legs 26 and 28 and toward the leg 28. The leg 26 terminates at its tip 29 in an inclined surface that is inclined with respect to axis 26' the same angle as the walls 40, 42, FIG. 6. The notches 36, and 38 thus form a parallelogram in transverse area.

The leg 28 terminates in a bight 44 forming a reversibly bent barb 46. The barb 46 terminates at a sharp edge 48 formed by an inclined end edge surface relative to the axis of the barb portion of the wire shackle. The barb at edge 48 defines an outer envelope value distance d1, FIG. 3. In the case of a reversibly bent barb, the term envelope involves more than the mere diameter or cross section of a leg, per se. In this case, the term envelope includes the maximum transverse dimension of the area formed by the combined transverse dimension of the leg 28 and the barb 46 and the leg 28 thickness assuming the leg thickness is uniform throughout. In the example of a barb, such as barb 46, the term envelope value refers to the maximum dimension of the transverse area encompassed by the leg 28 and the barb 46 furtherest point from the leg 28 and the thickness of the leg 28. The transverse envelope of leg 28 in the plane of the barb 46 thus is defined by the cross section area of the barb distance d1 and the thickness of the leg 28 normal to distance d1. Distance d1 is the maximum envelope value of the leg 28 and is significantly greater than envelope value distance d2 of leg 26 with only the notch. The barb 46 in combination with the leg 28 in dimension d1 thus normally will not permit leg 28 to be inserted into small hasp apertures that will readily receive the leg 26. Even if the barb 46 is fully compressed against the leg 28, it still defines a transverse dimension envelope value that is double the leg thickness and thus envelope value of the leg 28 in the direction of distance d1. If an entrance opening into a padlock body cavity has a transverse dimension and shape sufficient to receive only the single thickness of a leg such as leg 26, then a fully compressed barb 46 and leg 28 will not be able to penetrate into such an entrance opening. This results in the cavity entrance opening being keyed to the leg envelope size as well as to its shape. The term envelope value as used herein also includes a maximum transverse dimension of an envelope, a maximum area of the envelope or a given shape of the envelope formed by a shackle leg that is to be inserted into a body entrance opening.

In the alternative, instead of a notch, the leg 26 may have a barb, but of different dimensions than the barb 46 to form two barbs of dimensions d1 and d2. In this case the envelope value is defined by the uncompressed barbs. If the barbs were to be fully compressed against the corresponding leg, then they could define envelope values of the same size. It is intended that the term envelope value in the claims in connection with the use of barbs on both legs refers to a transverse dimension of a leg and barb, if any, in the undistorted configuration. In a further alternative, the legs may be formed of material of different diameters or thickness such that the dimensions d1 and d2 are provided that are different in envelope value.

In FIG. 5., locking insert 16 forms a first member that includes a central stem 50, which is rectangular in transverse section, a top cross member 52 and a bottom member 54. The different insert drawing figures are not to the same scale for illustration. The insert 16 divides the cavity 18 into first and second channels, 18' and 18", FIG. 4. A first array of cantilevered flexible fingers 56, 58 extend from one side wall 66 of the stem 52 into the first channel 18', FIG. 8. The fingers 56, 58 are aligned in an array in the axial direction of stem longitudinal axis 60. The fingers 56, 58 are generally of the same thickness into the drawing figure, and have generally the same length and configuration. These fingers preferably have the same square cross section shape, FIG. 7, and are inclined at an angle $\alpha$, about 45° relative to the axis 60, FIG. 5. The transverse shape may vary from square and may include rectangular and circular, or other shapes for example. The tip portions 62 are preferably identical and are defined by an edge surface 64 parallel to the axis 60 and aligned coplanar as are the remaining portions of the fingers 56, 58. The fingers 56, 58 are flexible in a common plane in directions parallel to the axis 60. The fingers 56, 58 have a thickness t, FIG. 5*a*, smaller than the thickness t' of the stem and extend centrally from the stem side wall 66 with respect to the insert broad sides 68 for reasons to be explained below.

Fingers 78, 80 extend from stem 50 at a side opposite the side of the stem from which fingers 56, 58 extend. Fingers 78, 80 extend into the second channel 18". The fingers 78, 80 are preferably at the same angle as fingers 56, 58 to the axis 60 and preferably have the same length and cross section, but may differ as desired according to a given implementation. The finger 78 preferably is staggered between the transverse planes (from left to right of the figure) of the junction of the fingers 56, 58 with the stem 50. The finger 80 is joined to the stem 50 a distance from the finger 78 that is the same as that of finger 58 to finger 56.

The fingers form a somewhat fishbone or herring bone pattern. The fingers 78, 80 preferably have the same tip portion 62 configuration as that of fingers 56, 58 with the tip edge surfaces coplanar parallel to axis 60 in this example. The tip portions 62 of the fingers extend into the subchannels 104 and 106. The subchannels 104 and 106 are shown by respective dashed lines 104' and 106', FIG. 4. The subchannels are defined by the respective overlying aligned entrance openings 101 and 103, FIGS. 4 and 12. The entrance openings receive the legs 26, 28 of the shackle for insertion into the cavity 18 and preferably are dimensioned to closely receive the corresponding leg and are of generally the same shape, e.g., a square opening for a square in section leg or rectangular opening for a rectangular leg. The entrance openings may be square or circular for circular cylindrical legs formed by round wire for example. The entrance openings 101 and 103 are formed by the spaced relation of the extension members 74, 76 of cross member 52 and the inside wall surfaces of the body 14, FIG. 12.

The top cross member 52, FIG. 5*b*, has a first surface 70 on opposite sides that is coplanar with the stem side 68 outer surface. A rectangular flange 72 extends outwardly from surface 70 of boss 71 on each side of the of member 52. The cross member 52 has like extension members 74, 76 that extend outwardly from the boss 71. As best seen in FIG. 5, the extension member 74 terminates at its end surface in a plane that is spaced from the plane of the tip portions 62 edge surfaces of all of the fingers a distance d2. The extension member 74 and its spacing from the body 14 thus forms entrance opening 101, FIG. 12, defining the corresponding subchannel 18' in body cavity 18. The extension member 76, FIG. 12, forms with the body 14, entrance opening 103 which defines the subchannel 106, FIG. 4.

The bottom member 54 of insert 16, FIG. 5, preferably has a section 82 of the same thickness as the stem 50, but is wider from left to right in the figure, and has outer broad surfaces 84 that are an extension of the stem outer surfaces 68. The member 54 preferably has a second section 86 and a third section 88 that are thinner than section 82. Section 86 preferably has a shoulder 90 closer to the finger 58 plane than section 88 shoulder 92. The member 54 has a circular segment bottom surface 94 that is of the same thickness as sections 86 and 88, the section 82 side surfaces 84 tapering toward this thickness at surface 94.

Figure 4:
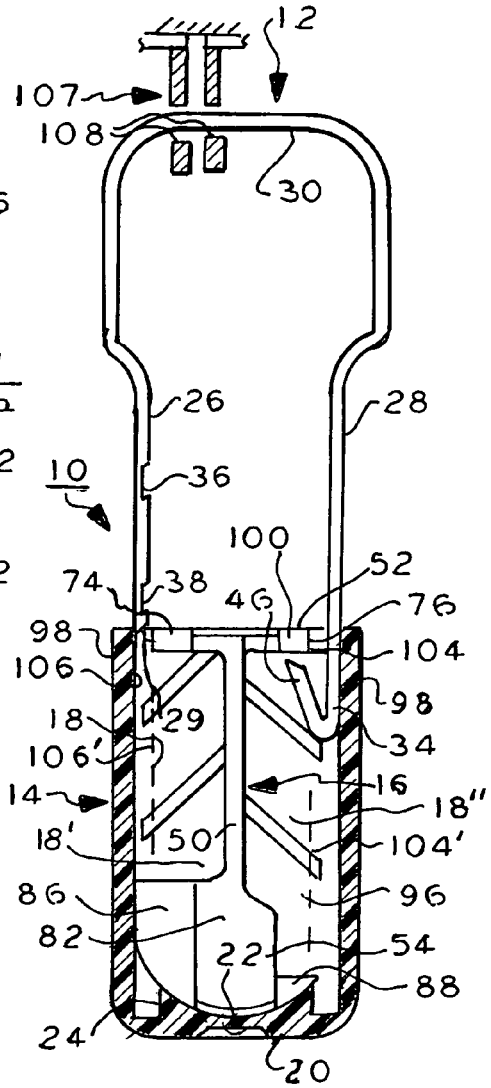
FIG. 4 is a side elevation sectional view of the seal of FIG. 1 with the shackle in a transport mode.

In FIG. 4, the body 14 has two opposing side walls 96 and two opposing end walls 98 terminating at bottom wall 20 forming a generally rectangular cavity 18. The cavity 18 has an open top forming entrance opening 100 into the cavity which opening receives the insert 16 and is enclosed at the bottom by wall 20. The wall 20 has an arcuate concave surface 22 in the cavity 18 that is complementary to and mates with and receives the convex surface 94 of the member 54, FIG. 5. The body 14, FIG. 1, cavity 18 has an open top region 102 that is configured to receive the cross member 52. The open top region with the cross member forms the entrance openings 101 and 103. In the alternative, the entrance openings can be formed by the cross member alone or by the body alone independently of the other.

In FIGS. 4, 5*b* and 12, the opening 100 of the cavity 18 and recesses formed in the body side walls 96 top edges receive the flanges 72. The insert 16 is assembled into the cavity 18 as shown in FIG. 1. The insert is then ultrasonically welded to the body 14 side walls 96. The surfaces 68 and 84 of the respective stem and member 54, FIG. 5*b*, abut the side walls 96 and are readily bonded thereto. The fingers and other surfaces of the sections 86 and 88 of the bottom member 54 are spaced from the side walls and are not bonded to the body. The flanges 72 and boss 71 also abut the body and are bonded thereto.

As seen in FIG. 2, the cavity 18 has a width f that is greater than that of the fingers and a length y that is also greater than the tip to tip distance of the fingers 56,58 on one side of the stem 50 to the fingers 78, 80 on the opposite stem side. This is also seen in FIGS. 4, 8 and 9. The spacing of the finger tip surfaces 64 (FIG. 5) from the end wall inner surfaces of the body in cavity 18 lie in the subchannels 104 and 106 in the cavity. The entrance openings 101 and 103 are preferably dimensioned to closely receive the legs 26, 28 (and its barb 46) of the shackle. The stem 50 divides the cavity 18 into two spaced first and second channels 18' and 18" with the fingers 56, 58 in the first channel and the fingers 78, 80 in the second channel and their tip portions in the respective subchannels.

In operation, in FIG. 4, the leg 28 barb 46 is inserted into opening 103, FIG. 12, of cavity 18 formed by the opening between the extension 76 and the body side wall 96. In the alternative, the barb 46 could also be inserted into opening 101 on the opposite side of the body 14. The barb is inserted by compression toward the leg 26 so as to fit into the opening 101 or 103. This compression resiliently deflects the barb 46. When the barb 46 is below the extension 76 (or extension 74) in the cavity 18, it appears as shown in FIG. 4. At this point the barb 46 is locked permanently to the body by the extension 76 (or 74). It is assumed at this point the user has passed the shackle through the openings 108 of a hasp such as hasp 107. The openings in the hasp 107 are too small to receive the barbed leg end of the shackle 12. The shackle 12 leg 26, due to it being smaller in overall envelope then leg 28 with the barb 46 as discussed above, easily passes through the hasp openings 108. Once the barb 46 is locked inside cavity 18 to the insert 16 cross member 52 as shown in FIG. 4, it can not be removed.

The shackle leg 26 is then inserted into entrance opening 101 into either of the positions of FIG. 8 or FIG. 9 in the subchannels 104', 106' to fully lock the legs 26 and 28. The entrance openings 101 and 103 limit the size of the cross section area and shape of the legs of the shackle that may be inserted into the cavity 18. During this insertion, the fingers flex to receive either the barb 46 or the leg 26 in the subchannels 104' and 106', the subchannels being transversely narrower than the leg 26 or the barb 46. The fingers flex toward the bottom member 54 and then spring back when the barb passes beneath the finger or the leg 26 notches 36 or 36 are aligned with the finger tip regions 62, FIG. 5. The finger tip regions 62 then seat into the respective notch(s) as shown in FIGS. 8 and 9. In FIG. 8, only the notch 38 is engaged (with the finger 56). In FIG. 9, both notches are engaged with respective fingers 56 and 58. This full engagement of both notches and the location of the barb inside of the cavity securely locks both legs of the shackle in place.

If the shackle base 30 were to be severed by a tamperer, the leg 26 may be rotated and removed. However, the leg 28, due to the barb present can not be removed and the leg 28 will provide evidence of tampering. A new shackle can not be inserted in its place as there is insufficient room. It is best that the shackle be inserted fully as in FIG. 9. In this way, even if the shackle were severed flush with the top of the body 14, the legs 26 and 28 could not be pushed into the cavity 18 out of the way due to the presence of the bottom member shoulders 90 and 92, FIG. 5. These legs and shoulders thus block the subchannels and prevent the insertion of a new shackle. At least the leg 28 can not be removed and such a new shackle is precluded from use with the body 14 once it is used with a shackle.

FIGS. 10 and 11 show an insert 110 according to a further embodiment. The insert has a top cross member 112, a stem 114 and a bottom member 116. The top cross member 112 is the same as the top cross member 52 in FIG. 5 except for a depending wedge member 118 which has a wedge inclined surface that is parallel to the finger angles. The wedge member 118 is flush with the outer surface 122 of extension 120 and serves to further lock the barb in the body cavity.

The stem 114 has a hollow center open region 124. Indicia including characters such as the alphabet or numerals, e.g., the manufacturer name 126, is located and molded into the open region 124. The stem has three fingers 128, 130 and 132 on one side and three fingers 134, 136 and 138 on the opposite side. The finger 132 is thicker at portion 133 at its junction with the stem 114 and flush therewith so it can be ultrasonically bonded to the mating body in the body cavity. The finger 134 is similarly thicker at its junction with the stem 114 for the same purpose. The bottom member 116 may be identical to the member 54, FIG. 5, or differ therefrom according to a given implementation. The same shackle used in FIG. 1 may be used with the insert 110.

In FIG. 11*a*, an insert 190 according to a further embodiment has a stem 192 from which project fingers 192, 194, 196 on one stem side and fingers 198, 200, 202 from the other side of the stem 193. The insert 190 preferably is molded thermoplastic but may be other materials. The insert has a top cross member 204 and a bottom member 206 configured substantially as described above for the other embodiments. Fingers 198 and 200 have respective notches 208 and 210 formed in their upper surfaces of the tip portions facing toward the top cross member 204. The notches 208 and 210 are V- or U-shaped forming a channel oriented into and out of the drawing. The notches 208 and 210 provide tamper deterrence.

The fingers 198, 200 and 202 are arranged to receive the notched leg of the shackle, such as leg 26, FIG. 1. It is contemplated that a tamperer may attempt to release the locked leg 26 by inserting a thin relatively stiff shim, such as a section of a credit card, for example, or sheet metal, into the channel of the body cavity, such as cavity 18, FIG. 8, through the opening 101, FIG. 12. The stiff shim would be used to release the notches of the shackle leg 26 from the finger tip portions 62, FIG. 5.

The finger notches 208 and 210 serve to capture the tampering shim and prevent it from entering the interface between a finger tip end surface and the corresponding shackle leg notch. If the shim were at the interface it could be inserted sufficiently to release the notched shackle leg. The shim is locked in the notch 208 or 210 and can not slide off of the finger as the finger is attempted to be deflected out of the leg 26 notch 36 or 38. Without the notches 208 or 210, a thin shim when forced against a finger, slides along the finger to its tip region due to the inclination of the finger. At the tip region, the shim may be forced against the interface of the finger tip and shackle leg notch to force the finger out of the shackle leg notch. By putting the notches 208 and 210 in the fingers, the shim can not slide toward the leg-finger interface to disengage the finger from the associated leg notch. This precludes such a shim from disengaging the shackle leg from locking engagement with the associated finger.

In FIG. 13, a shackle 140 comprises molded thermoplastic material. The Shackle 140 has two legs 142 and 144. The legs 142 and 144 are the same in cross section and are square although they may also be rectangular or circular according to a given implementation. In FIG. 14, the legs 142 and 144 are shown in more detail. Notch 146 and barb 148 are molded into the respective legs.142 and 146. The legs 142 and 146 are dimensioned to fit in the subchannels 106' and 104', respectively, FIG. 4, of the body 14. The notch 146 of leg 142 engages either of the finger tip regions 62, FIG. 5, for locking the leg 142 to a finger. Withdrawal of the leg 142 tends to flex the finger in the opposite direction which it can not due to the radius of the arc as the finger flexes. This action causes the finger to jam against the leg which is abutting the side of body forming the cavity 18. Because the leg 142 is square and the entrance openings 101 or 103, FIGS. 4 and 12, are also square or rectangular, even if the shackle were to be severed, the leg 142 can not be rotated to remove it from the cavity 18 and thus remains locked in the cavity. The shackle 140 may be molded of high strength engineering plastics as known in the plastics art such as available from the General Electric company. Such a shackle may also be reinforced with high strength fibers such as fiberglass or Kevlar, a polyamide plastic, available from Du Pont. Such reinforced plastic material has high strength. The plastic shackle may also be round or oval or any other geometric cross sectional shape as desired for a given implementation, such as a septagon, or hexagon polygon and so on.

In FIG. 15, the body 150 which may be of similar construction as the body 14, FIG. 4, has a cavity 152 in which a locking insert 154 is located. The insert 154 which preferably is molded plastic, but which may also be die cast metal such as zinc has recesses 156 having locking shoulders 158 arranged in an axial array. The shoulders engage and lock the barb of the shackle such as barb 148, FIG. 13, or barb 46, FIG. 1 and so on. The shoulders 158 are in channel 160. On the opposite side of the insert in channel 162, a set of wire fingers 164, 166 are cantilevered from the molded insert central member 168. The fingers 164, 166 are embedded into the central member 168 as shown. There may be one or more such fingers in a channel as shown for example, in FIG. 16. The central member may be formed of materials other than plastic such as metal or molded die cast metal such as zinc. The body 150 or body 14 may also be molded metal, but since it is preferred that the body be transparent or at least partially transparent, plastic is preferred.

In FIG. 16, the body 150 cavity includes a plastic molded insert 170 which has only one finger 171, 173 in each respective channel 172 and 174. In FIG. 17, the body 150 has an insert 176 which has fingers 178 on one side and locking recesses 180, such as recesses 156 of FIG. 15, formed into the side wall of the insert 176 on its opposite side. Fingers 178 may be plastic and molded integral one piece with the insert 176 or may be metal or plastic elements formed separately from the insert central member 182 and attached thereto. The fingers may have any cross section shape as desired and arranged to mate with the notches in the shackle, whether round or square or other shaped material and whether plastic or metal.

In FIG. 18, leg 180 of molded thermoplastic shackle 182 is square in cross section and has a transverse dimension d'. The leg 184 is rectangular in cross section and has a transverse dimension d" much greater than d'. Thus leg 180 has a larger envelope, i.e., cross sectional area, than that of leg 184. Leg 184 has openings 186, 188 to save material. The mating locking insert 214 with locking fingers is shown in dashed lines as is a portion of the seal body 212. In essence the legs 180 and 184 are keyed to a corresponding dimensioned entrance opening in the body 212. The notches 216 may be shaped as shown with an inclined upper surface and a lower surface normal to the longitudinal leg axes 218.

It will occur to one of ordinary skill that modifications may be made to the disclosed embodiments without departing from the scope of the invention as defined in the appended claims. The disclosed embodiments are given by way of illustration and not limitation. For example, the fingers may be of different configurations and number than that shown. They may be circular cylindrical or rectangular instead of square in cross section, The angle of the fingers may differ from that shown. The fingers on opposing sides may be mirror images instead of staggered as shown. The subchannels may be arranged to receive the shackle legs in only one orientation instead of in reverse orientations, i.e., each leg only will mate in one corresponding entrance opening into the body cavity. The fingers may project from a central stem member at other than 180° relative to each other in plan view, FIG. 12. While notches are arranged to receive the mating tip portion of a finger in the disclosed embodiments in at least one subchannel, it should be appreciated that the reversibly bent barbs which are disclosed as mating with such fingers in one embodiment, also may mate with shoulders, recesses, bumps or other mating configurations in the body cavity for locking the barb to the body cavity in the other channel. Thus the central stem member may have different configurations on opposing sides.

The notches in the shackle leg may be formed as recesses or depressions surrounded by four walls rather than channels having only two side walls as shown herein. The term notch includes recesses, depressions, channels and so on. It is intended that the appended claims define the invention. While only alphabet characters are shown in one embodiment, indicia molded into the opening of the insert central stem member may also include numerals or alpha-numeric indicia. The legs of the shackle thus may have different configurations, and the locking devices in the body cavity in opposing channels may have the same or different configurations. The shackle legs may be received in the locking body in one orientation or in different orientations. The shackle, body and insert may be constructed of any desirable material according to a given implementation.

What is claimed is:

1. A tamper evident security seal comprising:

a body having a cavity with first and second channels;

a first locking device in the first channel and second locking device in the second channel;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value; and the second leg having a fourth locking device for engaging the second locking device in the second channel, the second leg and fourth locking device defining a second outer envelope having a value larger than that of the first value such that the first leg can pass through an opening smaller than the second leg;

the fourth locking device comprising a reversibly bent barb and the third locking device comprises a notch; and the first and second locking devices comprise cantilevered fingers each having a tip portion.

2. The seal of claim 1 wherein the third and fourth locking devices have different configurations from each other.

3. The seal of claim 1 wherein the fingers have identical tip portions.

4. The seal of claim 1 wherein the first locking device comprises fingers and the second locking device comprises recesses with shoulders.

5. The seal of claim 1 wherein the first and second locking devices have different configurations.

6. The seal of claim 1 wherein the first and second locking devices have a different configuration from each other, and the third and fourth locking devices have a different configuration from each other.

7. The seal of claim 1 wherein the first locking device comprises metal fingers extending from and secured to a plastic stem member in the cavity and forming the cavity into the first and second channels.

8. The seal of claim 1 wherein the first and second locking devices comprise a stem member in the cavity forming the first and second channels, the stem member including at least one of cantilevered fingers and recesses with shoulders in the channels.

9. The seal of claim 1 wherein the first and second locking devices include identical locking portions for selectively engaging either the barb or notch.

10. The seal of claim 1 wherein the first and second locking devices comprise a plurality of cantilevered fingers forming first and second arrays extending in each channel.

11. The seal of claim 1 including a first member in the cavity forming the first and second channels, the first and second locking devices comprising a plurality of flexible fingers cantilevered from the first member in each of the first and second channels, the channels extending in an axial direction, the fingers extending transversely to the axial direction in first and second axial arrays, the fingers having tip portions spaced from the body for locking engagement with the notch and barb.

12. The seal of claim 1 wherein the second locking device comprises cantilevered fingers, the third locking device comprising a first plurality of notches, a second plurality of notches of the first plurality for engaging a different finger at the same time.

13. The seal of claim 1 wherein the tip portions are dimensioned to engage either of the notch and the barb.

14. The seal of claim 1 wherein the first and second locking devices comprise cantilevered fingers, and wherein the third locking device comprises a first plurality of notches, a second plurality of the notches of the first plurality for engaging a different finger at the same time, the barb being disengaged from the fingers while said fingers are engaged with said notches.

15. The seal of claim 11 wherein the body has a bottom wall with an arcuate bottom wall surface in the cavity, the cavity having an open top and enclosed bottom formed by the body bottom wall, the first member having a first transverse width and terminating at a first end in a cross member, the cross member overlying a major portion of said fingers and arranged to form the open top into first and second entrance openings aligned with the first and second channels and defining subchannels in the first and second channels for receiving the shackle legs, the first member terminating at a second end distal the first end, the second end being arcuate and complementary to the body bottom wall and for overlying said fingers.

16. The seal of claim 1 wherein the notch being defined by a recess having a parallelogram shape.

17. The seal of claim 16 wherein the second locking device comprises fingers that terminate in tips having a shape complementary to said parallelogram shape for selective engagement in said recess.

18. The seal of claim 1 wherein the shackle is selected from any one or more of the group consisting of wire or molded plastic, each leg of the shackle being any one of a square, round or rectangular in transverse section.

19. The seal of claim 1 wherein the first locking device comprises a locking element for locking engagement with the notch and the second locking device comprises a cantilevered finger for locking engagement with the barb, both the element and the finger being attached to a central stem member.

20. The seal of claim 1 wherein the first or second locking devices comprise at least one cantilevered finger of reinforced plastic.

21. The seal of claim 1 wherein the first or second locking devices comprise at least one cantilevered finger of metal wire.

22. The seal of claim 1 wherein the first or second locking devices comprise at least one cantilevered finger selected from the group consisting of any one or more of a square plastic or square metal material, a rectangular plastic or rectangular metal material, a round metal or round plastic material, a fiber reinforced plastic material, and a polygon metal or plastic material.

23. The seal of claim 1 wherein the first and second locking devices respectively comprise a finger and a recess, the finger for engaging the notch and the recess having a shoulder for engaging the barb.

24. The seal of claim 1 wherein the first locking device comprises a series of fingers in an axial array and the third locking device comprises a series of notches in the first leg for simultaneous engagement with a plurality of the fingers.

25. The seal of claim 1 wherein the second locking device comprises at least one recess with a shoulder for engagement with the barb and the first locking device comprises at least one finger for locking engagement with the notch.

26. The seal of claim 1 including a first separate and discrete member in the cavity forming said first and second channels, the first member having an opening therein, the opening including indicia molded and integral one piece therewith.

27. A tamper evident security seal comprising:

a body defining a cavity having an opening;

a first member located in the opening and in the cavity for forming the opening into first and second entrance openings in the cavity and forming the cavity into first and second channels aligned with a respective corresponding entrance opening, the channels defining an axial direction, the first member having opposing first and second sides in the cavity and at least one finger cantilevered from the first side in the first channel and a first locking device comprising at least one recess at the second side, the at least one finger terminating at a tip portion spaced from the body, the at least one finger being inclined relative to the axial direction; and a shackle having first and second legs, the first leg for insertion into the first channel and the second leg for insertion into the second channel, each leg having a corresponding different second and third locking device for engaging said tip portion and first locking device respectively, to thereby lock the legs in said cavity, the second position toeach other.

28. The seal of claim 27 wherein the first and second entrance openings have different dimensions, the legs each having a corresponding outer envelope of different dimensions for insertion into and mating with a different first and second entrance opening.

29. The seal of claim 27 wherein the at least one finger includes a plurality of fingers in an axial array in the first channel, all of the fingers having identical tip portions.

30. The seal of claim 27 wherein the second locking device comprises at least one notch for engaging said fingers and the third locking device comprises a reversely bent barb for engaging the at least one recess.

31. The seal of claim 30 wherein the at least one finger comprises a plurality of fingers, the at least one notch comprises a plurality of notches for simultaneously engaging a like plurality of said fingers.

32. The seal of claim 31 wherein the barb is disengaged from the at least one recess while the notches are engaged and vice versa.

33. The seal of claim 27 wherein the first member has an end that includes a cross member for bonding to the body, the cross member for overlying the fingers and arranged for engaging and locking one of the second and third locking device in said cavity.

34. The seal of claim 27 wherein the first member has a first width that abuts the body in said cavity and the fingers have a second width narrower than the first width such that the fingers are spaced from the body in said cavity.

35. The seal of claim 27 wherein the first member has an open region, the open region including alpha and/or numeric indicia characters molded and integral one piece with the first member for conveying information as in a writing.

36. The seal of claim 35 wherein the open region is through the first member.

37. The seal of claim 29 wherein the first member forms a locking member in the cavity and comprise a plastic molded stem member and said at least one finger is at least one flexible metal finger extending from and molded fixed unmovable to and at the junction with the stem member.

38. The seal of claim 37 wherein the body is molded plastic.

39. The seal of claim 37 further including a second metal finger extending from the stem member opposite to the direction of extension of the at least one metal wire finger, and a shackle with two legs, one leg having a notch for engagement with one of said fingers and a second leg with a reversibly bent barb for engagement with the other of said fingers.

40. A tamper evident security seal comprising:

a transparent molded plastic body having a cavity;

a first locking device including an insert in the cavity, the insert having a stem member and at least one of locking fingers and locking recesses coupled to the stem member, said stem member having an opening therein, the opening including three dimensional aloha and/or numeric indicia characters located therein for conveying information as in a writing and visible through the body; and a shackle having a second locking device for insertion into the cavity and selective engagement with the first locking device.

41. The seal of claim 40 wherein the shackle has first and second legs, the first leg having a notch for engagement with the locking device fingers and the second leg having a barb for engagement with said one of said fingers and locking recesses.

42. The seal of claim 40 wherein the first locking device comprises cantilevered fingers.

43. The seal of claim 42 wherein the shackle has a first leg with notches and a second leg with a reversibly bent barb, the barb and notches for engaging said fingers.

44. The seal of claim 40 wherein the characters are molded one piece integral with the stem.

45. A seal comprising:

a body having a cavity;

a locking member in the cavity and comprising a stem member and at least one flexible finger extending from and fixed to the stem member;

an entrance opening in communication with the cavity and defining a leg receiving subchannel in the cavity, the at least one flexible finger having a tip portion in the subchannel; and a shackle having a locking leg, the leg for insertion into the subchannel through the opening, the locking leg having a notch for locking engagement with the at least one finger tip portion in the channel, the at least one flexible finger having a notch adjacent to the finger tip portion and facing toward the entrance opening arranged to preclude tampering release of the engaged finger and leg notch.

46. A tamper evident security seal comprising:

a body having a cavity with first and second channels;

a first locking device in the first channel and second locking device in the second channel, the first locking device comprises metal fingers extending from and secured to a plastic stem member in the cavity and forming the cavity into the first and second channels;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg; and the fourth locking device comprising a reversibly bent barb and the third locking device comprises a notch.

47. A tamper evident security seal comprising:

a body having a cavity with first and second channels;

a first locking device in the first channel and second locking device in the second channel, the first and second locking devices comprise a stem member in the cavity forming the first and second channels, the stem member including at least one of cantilevered fingers and recesses with shoulders in the channels;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg; and the fourth locking device comprising a reversibly bent barb and the third locking device comprises a notch.

48. A tamper evident security seal comprising:

a body having a cavity with first and second channels;

a first locking device in the first channel and second locking device in the second channel;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg; and the fourth locking device comprising a reversibly bent barb and the third locking device comprises a notch, and the first and second locking devices include identical locking portions for selectively engaging either the barb or notch.

49. A tamper evident security seal comprising:

a body having a cavity with first and second channels;

a first locking device in the first channel and second locking device in the second channel, the first and second locking devices comprise a plurality of cantilevered fingers forming first and second arrays extending in each channel;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg; and the fourth locking device comprising a reversibly bent barb and the third locking device comprises a notch.

50. A tamper evident security seal comprising:

a body having a cavity with first and second channels;

a first locking device in the first channel and second locking device in the second channel;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value; and the second leg having a fourth locking device for engaging the second locking device in the second channel, the second leg and fourth locking device defining a second outer envelope having a value larger than that of the first value such that the first leg can pass through an opening smaller than the second leg;

the fourth locking device comprising a reversibly bent barb and the third locking device comprises a notch; and the first and second locking devices comprise cantilevered fingers each having a tip portion dimensioned to engage either of the notch and the barb.

51. A tamper evident security seal comprising:

a body having a cavity with first and second channels;

a first locking device in the first channel and second locking device in the second channel;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg;

the fourth locking device comprising a reversibly bent barb and the third locking device comprises a notch, the notch being defined by a recess having a parallelogram shape; and the second locking device comprises fingers that terminate in tips having a shape complementary to the parallelogram shape for selective engagement in the recess.

52. A tamper evident security seal comprising:

a body having a cavity with first and second channels;

a first locking device in the first channel and second locking device in the second channel, the first or second locking devices comprise at least one cantilevered finger of metal wire;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg; and the fourth locking device comprising a reversibly bent barb and the third locking device comprises a notch.

53. A tamper evident security seal comprising:

a body having a cavity with first and second channels;

a first locking device in the first channel and second locking device in the second channel;

a first separate and discrete member in the cavity forming the first and second channels, the first member having an opening therein, the opening including indicia molded and integral one piece therewith;

a shackle having first and second legs, the first leg for insertion into the first channel and the second leg for insertion into the second channel;

the first leg having a third locking device for engaging the first locking device in the first channel to lock the first leg in the first channel, the third locking device and first leg together defining a first outer envelope of a first value;

the second leg having a fourth locking device for engaging the second locking device in the second channel, the second leg and fourth locking device defining a second outer envelope having a value larger than that of the first value such that the first leg can pass through an opening smaller than the second leg; and the fourth locking device comprising a reversibly bent barb and the third locking device comprises a notch.

54. A tamper evident security seal comprising:

a body defining a cavity having an opening;

a first member forming the opening into first and second entrance openings into the cavity and forming the cavity into first and second channels aligned with a respective corresponding entrance opening, the first member having opposing first and second sides and at least one finger cantilevered from the first side in the first channel and a first locking device comprising at least one recess at the second side, the at least one finger terminating at a tip portion spaced from the body, the at least one finger being inclined relative to the axial direction;

a shackle having first and second legs, the first leg for insertion into the first channel and the second leg for insertion into the second channel, each leg having a corresponding different second and third locking devices for engaging the tip portion and the first locking device to thereby lock the legs in the cavity;

the second device comprises at least one notch for engaging the at least one finger and the third locking device comprises a reversely bent barb for engaging the at least one recess;

the at least one finger comprises a plurality of fingers, the at least one notch comprises a plurality of notches for simultaneously engaging a like plurality of the fingers; and the barb is disengaged from the at least one recess while the notches are engaged and vice versa.

55. A tamper evident security seal comprising:

a transparent molded plastic body having a cavity;

a first locking device including an insert in the cavity, the insert having a stem member and at least one of locking fingers and locking recesses coupled to the stem member, said stem member having an opening therein, the opening including three dimensional indicia characters located therein and visible through the body;

a shackle having a second locking device for insertion into the cavity and selective engagement with the first locking device and the first locking device comprises cantilevered fingers; and the shackle has a first leg with notches and a second leg with a reversibly bent barb, the barb and notches for engaging the fingers.

* * * * *

UNITED STATES PATENT AND TRADEMARK OFFICE

CERTIFICATE OF CORRECTION

PATENT NO. : 6,966,584 B2
DATED : November 22, 2005
INVENTOR(S) : Robert F. Debrody et al.

It is certified that error appears in the above-identified patent and that said Letters Patent is hereby corrected as shown below:

Column 14,
Line 67, after "second" insert:
-- and third locking devices having locking structure differing from one another independent of their relative length, orientation and --.

Signed and Sealed this

Fourteenth Day of February, 2006

JON W. DUDAS
*Director of the United States Patent and Trademark Office*